United States Patent [19]

Fauvet

[11] Patent Number: 5,054,807

[45] Date of Patent: Oct. 8, 1991

[54] RELEASABLE BINDING ASSEMBLY

[75] Inventor: Jean-Francois Fauvet, Grenoble, France

[73] Assignee: Salomon S.A., Annecy Cedex, France

[21] Appl. No.: 440,861

[22] Filed: Nov. 24, 1989

[30] Foreign Application Priority Data

Nov. 25, 1988 [FR] France ..... 88 15732

[51] Int. Cl.[5] ..... A63C 5/03; A63C 9/08

[52] U.S. Cl. ..... 280/607; 280/618; 280/633; 280/634; 280/14.2

[58] Field of Search ..... 280/14.2, 607, 617, 280/618, 620, 627, 633, 634, 636; 441/70, 73

[56] References Cited

U.S. PATENT DOCUMENTS

| | | | |
|---|---|---|---|
| 4,294,460 | 10/1981 | Kirsch | 280/617 X |
| 4,652,007 | 3/1987 | Dennis | 280/618 |
| 4,728,115 | 2/1988 | Pozzobor et al. | 280/613 |
| 4,728,116 | 3/1988 | Hill | 280/618 |
| 4,741,550 | 5/1988 | Dennis | 280/618 |
| 4,772,041 | 9/1988 | Klosterman | 280/618 X |
| 4,792,155 | 12/1988 | Besnier | 280/607 |
| 4,844,502 | 7/1989 | Besnier | 280/607 |
| 4,869,522 | 9/1989 | Besnier et al. | 280/607 |
| 4,869,524 | 9/1989 | Bouque | 280/617 |

FOREIGN PATENT DOCUMENTS

| | | | |
|---|---|---|---|
| 0335463 | 10/1989 | European Pat. Off. | 280/618 |
| 2595256 | 9/1987 | France | 280/607 |
| 2611516 | 9/1988 | France | 280/607 |
| 8716539 | 5/1989 | France . | |
| 2628000 | 9/1989 | France | 280/14.2 |
| 8903711 | 5/1989 | World Int. Prop. O. | 280/627 |
| 8910167 | 11/1989 | World Int. Prop. O. | 280/618 |

*Primary Examiner*—Andres Kashnikow

*Assistant Examiner*—Brian L. Johnson

*Attorney, Agent, or Firm*—Sandler, Greenblum & Bernstein

[57] ABSTRACT

A binding arrangement for use with a gliding board, such as a snowboard or monoski. The binding arrangement includes a first releasable binding for rigidly affixing a first boot to the gliding board and a second releasable binding for rigidly affixing a second boot to the gliding board. Each of the releasable bindings includes an intermediate plate affixed to the boot, and a base affixed to the gliding board. The intermediate plate is retained on the base in a releasable manner by a retention mechanism which includes a fixed abutment rigidly affixed to the base, and an abutment movable with respect to the base. The movable abutment can be activated between an armed position, in which the retention mechanism elastically retains the intermediate plate, and an unarmed position, in which the retention mechanism permits the release of the intermediate plate. In the armed position, each of the movable abutments is elastically biased in the direction of the associated fixed abutment, against the return force of an elastic return system. A linkage device connects between them the respective retention mechanisms of the two boots such that the release of one of the boots lowers the return force that the elastic return system exerts on the movable abutment joined to the other boot. Each movable abutment of this assembly of releasable bindings is guided to slide in a sealed manner, in a partially closed cylinder at one of its ends so as to define a corresponding sealed rear chamber. Further, the linkage device includes at least one flexible conduit which connects the two sealed rear chambers to each other, the two sealed rear chambers and the linkage device being filled with a hydraulic fluid.

31 Claims, 8 Drawing Sheets

2
20
73
71
61
70
73
72
65
71
64
64
65
6
8
60
81
82

RELEASABLE BINDING ASSEMBLY

BACKGROUND OF THE INVENTION

1. Field of the Invention

The present invention is directed to a releasable binding assembly for a gliding board such as monoski or snowboard, comprising first and second releasable bindings to rigidly affix first and second boots, respectively, to the gliding board.

2. Description of Background Information

There are numerous known types of releasable bindings used in the field of alpine skiing. With the use of snowboards or monoskis, however, the problems presented are different from those of a conventional alpine ski.

In fact, in the case of a snowboard or monoski, the two feet are rigidly affixed to the same gliding board. In addition, the forces sustained by the knees, legs, and ankles of the skier are very strong because the two feet are connected to a single board. Thus, there tends to be a greater potential for a foot or leg injury due to the relatively great weight of the board compared, e.g., to the weight of a conventional ski. The primary danger arises when only one of the skier's boots is disconnected from the gliding board, the other leg then being subjected to significant forces.

Releasable binding assemblies are presently known for fixing a skier's boots to a gliding board which make it possible, when one of the boots becomes disconnected from the gliding board, to reduce or eliminate the release threshold of the other boot, so that it becomes separated, in turn, from the gliding board. French Patent Application Nos. 88.09510 and 87.16539 are exemplary. In other words, as soon as a boot is released by its binding, a linkage device makes it possible to act on the other binding so that it releases its boot. However, this construction has the disadvantage of presenting a linkage device constituted by a cable, which can creates losses of energy transmitted by the cable, from one releasable binding to the other, by rubbing of the cable in its sheath Consequently, this reduces the linkage efficiency between the two releasable bindings.

SUMMARY OF THE INVENTION

It is, therefore, an object of the present invention to provide a binding arrangement for a gliding board including a first releasable binding for rigidly affixing a first boot to the gliding board and a second releasable binding for rigidly affixing a second boot to the gliding board and a linkage device for which the efficiency is not subject to the aforementioned problem.

According to the present invention, each of the releasable bindings includes a base adapted to be affixed to the gliding board; an intermediate plate adapted to be affixed to the boot; and means for releasably retaining the intermediate plate on the base, each of the releasable retention means including a fixed abutment rigidly affixed to the base, and a movable abutment which is movable with respect to the base within a sealed cylinder having a sealed rear chamber. The movable abutment is operable between an armed position, in which the releasable retention means retains the intermediate plate, and an unarmed position, in which the releasable retention means allows the release of the intermediate plate with respect to the base. In the armed position, the movable abutment is elastically biased toward the fixed abutment, against the return force of an elastic return system.

The apparatus also includes a linkage device connecting the first releasable binding and the second releasable binding, wherein release of the boot functions to lessen the return force of the elastic return system which is exerted on the movable abutment and by the movable abutment against the other boot, the linkage device including at least one flexible conduit connecting the sealed rear chamber of the movable abutment of the first releasable binding and the rear chamber of the movable abutment of the second releasable binding, the sealed rear chambers and the flexible conduit being filled with a hydraulic fluid.

According to a particular aspect of the invention, the binding arrangement includes a master cylinder having a piston slidable therein and a main compression spring exerting a force against the piston for generating a pressure of the hydraulic fluid, wherein the linkage device includes at least two flexible conduit segments, each of the segments of the flexible conduit connecting a respective sealed rear chamber to the master cylinder.

The master cylinder includes a pusher assembly and a main spring having one end biased against the main piston and another end biased against the pusher assembly, the master cylinder further including an arming lever operable for translating the pusher assembly within the master cylinder.

Still further, a cam is mounted for rotation with respect to the master cylinder, the arming lever includes a lever for controlling the rotation of the cam, and the cam effects translation of the pusher assembly during rotation of the cam, between an arming position wherein the pusher assembly compresses main spring, and a released position wherein pusher assembly exerts a force less than a given threshold on the main spring.

Preferably, according to the present invention, the cam is biased in rotation by at least one torsion spring to bias the pusher assembly to return to the released position as soon as at least one of the intermediate plates is released with respect to the means for retaining. The pusher assembly includes at least an abutment pusher, a secondary piston, and a screw-nut mechanism, wherein the screw-nut mechanism is operable to adjust the distance between the abutment pusher and the secondary piston to vary the compression force of the main spring.

According to a further aspect of the invention, a compression spring is located within the sealed rear chamber of the movable abutment so as to abut against an end of the sealed rear chamber, such that the compression spring exerts a force toward the fixed abutment.

According to a still further aspect of the invention, the fixed abutment of each binding is located forwardly of the movable abutment with respect to the ski on an axis substantially parallel to the longitudinal axis of the gliding board.

It is a further object of the invention to provide a first binding assembly for retaining a first boot upon a ski, a second binding assembly for retaining a second boot upon the ski, and means for linking the first binding assembly and the second binding assembly and for reducing a threshold force exerted by one of the first binding assembly and the second binding assembly in response to release of a boot from the other of the first binding assembly and the second binding assembly, wherein each of the first binding assembly and the second binding assembly includes a respective fluid biasing mechanism for exerting a retention force against a respective one of the first boot and the second boot, and wherein the means for linking includes a conduit connected between the fluid biasing mechanism of the first binding assembly and the fluid biasing mechanism of the second binding assembly.

According to a specific embodiment of the invention, the means for linking further includes a master cylinder, a conduit connected between the master cylinder and the first binding assembly, and a conduit connected between the master cylinder and the second binding assembly. The fluid is preferably hydraulic.

According to a further specific feature of the present invention, each of the first binding assembly and the second binding assembly includes a fixed abutment and a movable abutment, each of the movable abutments including a respective one of the fluid biasing mechanisms which includes a member biased by the fluid toward a respective one of the fixed abutments.

Still further, each of the fluid biasing mechanisms further includes a sealed chamber and wherein the member includes a piston movable within the chamber. Each of the chambers includes a compression spring located therein for exerting a force against the piston.

Preferably according to the present invention, each of the fixed abutments is adapted to be positioned forwardly of a respective one of the movable abutments with respect to the front of the ski.

In an additional aspect of the present invention, each of the first binding assembly and the second binding assembly includes a plate, means for affixing a ski boot to the plate, and means for releasably engaging the plate for retaining a respective one of the first boot and the second boot upon the ski.

Still further according to the present invention, each of the first binding assembly and the second binding assembly further includes means for adjustably positioning a respective one of the first boot and the second boot upon a respective one of the plates.

In a still further aspect of the present invention, the means for adjustably positioning a respective one of the first boot and the second boot includes means for selectively rotatably positioning the respective boot about an axis which is generally perpendicular to an upper ski surface.

In a further aspect of the invention the master cylinder includes a chamber in fluid communication with the conduits, wherein the master cylinder further includes a main piston movably mounted for effecting a change in the volume of the chamber, and means for manually reducing the biasing force of each of the fluid biasing mechanisms which includes means for effecting movement of the main piston for increasing the volume of the chamber.

In a further aspect of the invention, the means for manually reducing the biasing force of each of the fluid biasing mechanisms further includes a lever adapted to be accessible to the wearer of the boots.

Still further, the first binding assembly and the second binding assembly are adapted to position the first and second boots transversely on the ski, with respect to a longitudinal axis of the ski, and means are provided for adjusting the orientation of the boots with respect to the ski.

BRIEF DESCRIPTION OF THE DRAWINGS

The above and additional objects, characteristics, and advantages of the present invention will become apparent in the following detailed description, with reference to the accompanying drawings, which illustrate, by way of non-limiting examples, preferred embodiments of the present invention in which.

DETAILED DESCRIPTION OF THE PREFERRED EMBODIMENTS

Figure 1:
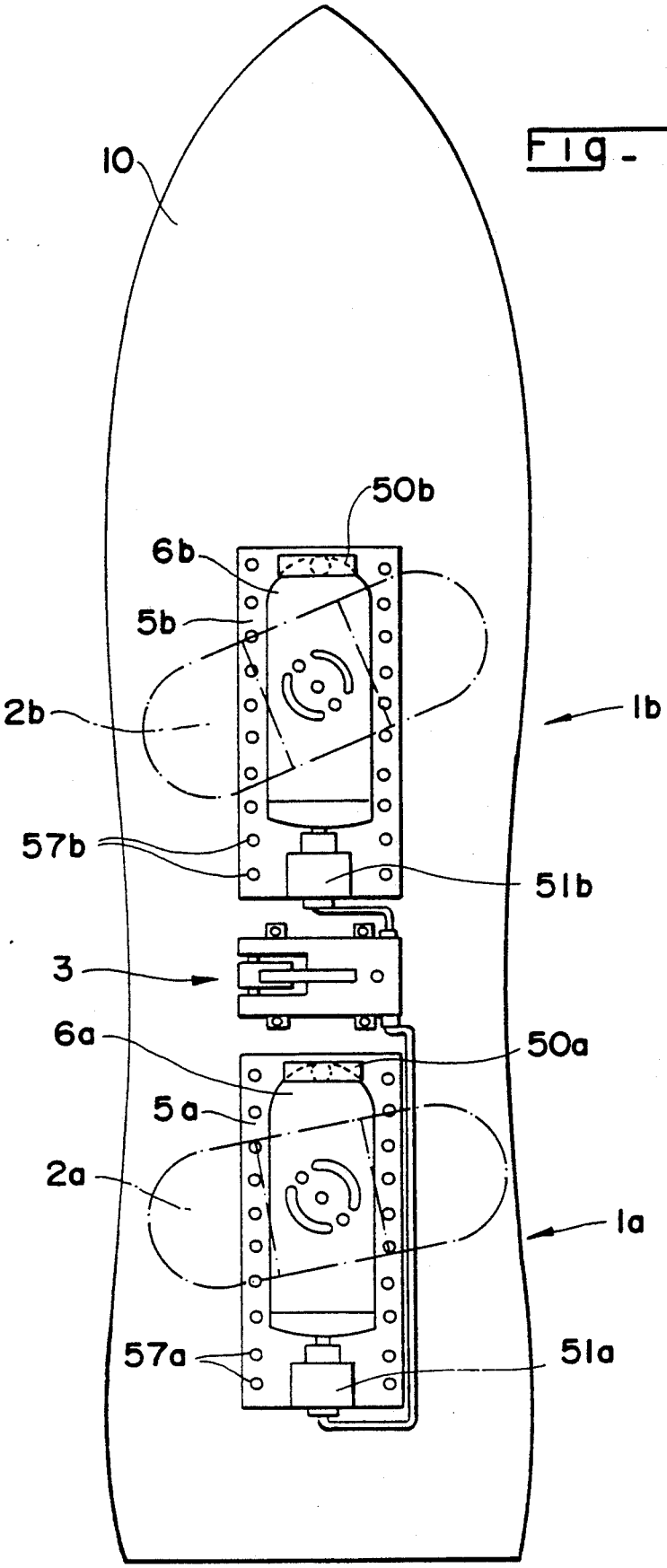
FIG. 1 is a plan view of the assembly of releasable bindings according to the invention mounted on a snowboard.

One of the objects of the present invention is to overcome the disadvantages noted above and to provide a linkage device which connects the bindings of the two boots of the skier to one another in a releasable manner. The release of a boot by its binding leads to the release of the other boot by its binding, the operation of the linkage device occurring with optimum efficiency.

It is a further object of the invention to provide an assembly of releasable bindings, connected by a linkage device which is not damaged, nor is the function of the linkage device changed, during twisting or flexion of the gliding board.

Another object of the present invention is to make it possible to modify the placement and orientation of the feet on the gliding board without modifying the placement or function of the linkage device of the two bindings between them.

Another object of the present invention is to enable the adjustment of the retention force of each boot in its associated binding.

These objects are attained in the assembly of releasable bindings according to the invention in that the assembly comprises a first releasable binding to rigidly affix a first boot to the gliding board and a second releasable binding to rigidly affix a second boot to the gliding board. Each of these releasable bindings includes:

an intermediate plate affixed to the boot by mounting means; and a base affixed to the gliding board by rigid affixation means.

The intermediate plate is retained on the base in a releasable manner by retention means constituted by:

a fixed abutment rigidly affixed to the base; and an abutment movable with respect to the base.

This movable abutment can be activated between an armed position, in which the retention means elastically retain the intermediate plate, and an unarmed position, in which the retention means permits the release of the intermediate plate.

In the armed position, each of the movable abutments is elastically biased in the direction of the associated fixed abutment, against the return force of an elastic return system.

A linkage device connects between them the respective retention means of the two boots such that the release of one of the boots lowers the return force that the elastic return system exerts on the movable abutment joined to the other boot.

Each movable abutment of this assembly of releasable bindings is guided to slide in a sealed manner, in a partially closed cylinder at one of its ends so as to define a corresponding sealed rear chamber. Further, a linkage device is provided which is constituted by at least one flexible conduit which connects the two sealed rear chambers to each other, the two sealed rear chambers and the linkage device being filled with a hydraulic fluid.

With regard to the drawings, certain elements which are the same for the two releasable bindings 1*a* and 1*b*, are designated by the same reference numeral, but with indices, a or b, when the description of the functioning requires differentiating between the two boots or bindings.

These same elements will be designated by the same reference, without index, when the description equally designates the elements from one or the other of bindings 1*a* or 1*b*.

FIG. 1 shows an assembly of releasable bindings 1*a*, 1*b* according to the invention, mounted on a snowboard 10. Such an assembly 1*a*, 1*b* could also be shown mounted on a monoski in which the feet are positioned side by side.

The assembly shown includes a first releasable binding 1*a* which rigidly affixes a first boot 2*a* to snowboard 10, and a second releasable binding 1*b* which rigidly affixes a second boot 2*b* to snowboard 10. Each releasable binding 1*a*, 1*b* is constituted by:

an intermediate plate 6 affixed to the boot 2 by mounting means 7; and a base 5 affixed to snowboard 10 by means for solid affixation, such as screws, insertable through openings 57.

Each intermediate plate 6 is retained on its corresponding base 5, in a releasable manner, by retention means 50, 51.

A linkage device 3 connects together the two retention means 50*a*, 51*a* which are joined to the boot 2*a* on the one hand, and retention means 50*b*, 51*b* which are joined to boot 2*b* on the other hand.

Figure 4:
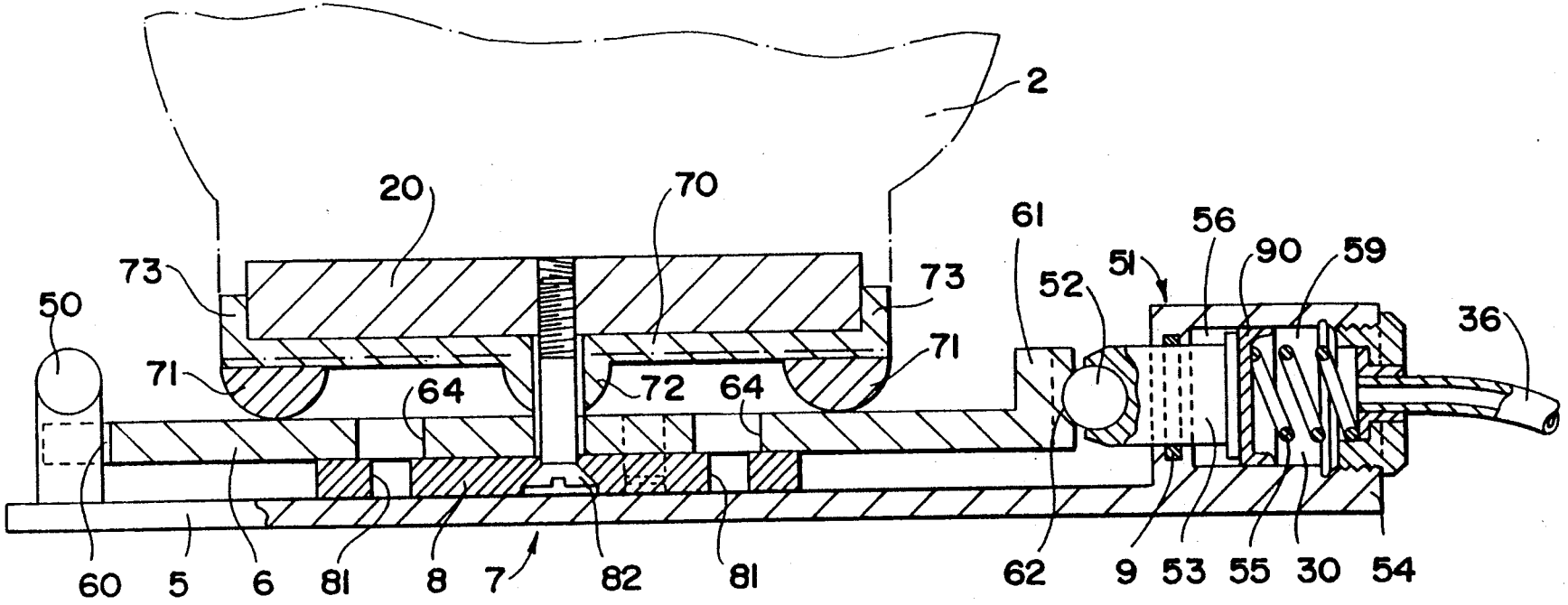
FIG. 4 is a longitudinal sectional view of a releasable binding according to the invention.

The mounting means 7 are constituted, for each boot 2, by an arrangement illustrated in FIG. 4. A metallic plate 20 is inserted in the sole of the boot 2. The sole of boot 2, generally of synthetic resin, can be cast, for example, on metallic plate 20. This embodiment is illustrated in FIG. 6, but is not to limit the invention to the arrangement shown, one with ordinary skill in the art being capable of conceiving another construction.

A shock absorbing plate 70 is positioned under insert plate 20 by means of edges 73. The shock absorbing plate 70 comprises a median part 72, preferably metallic, which rests on the intermediate plate 6. Two elastomeric rollers 71 are glued, screwed, or otherwise affixed, on the shock absorbing plate 70.

Figure 6:
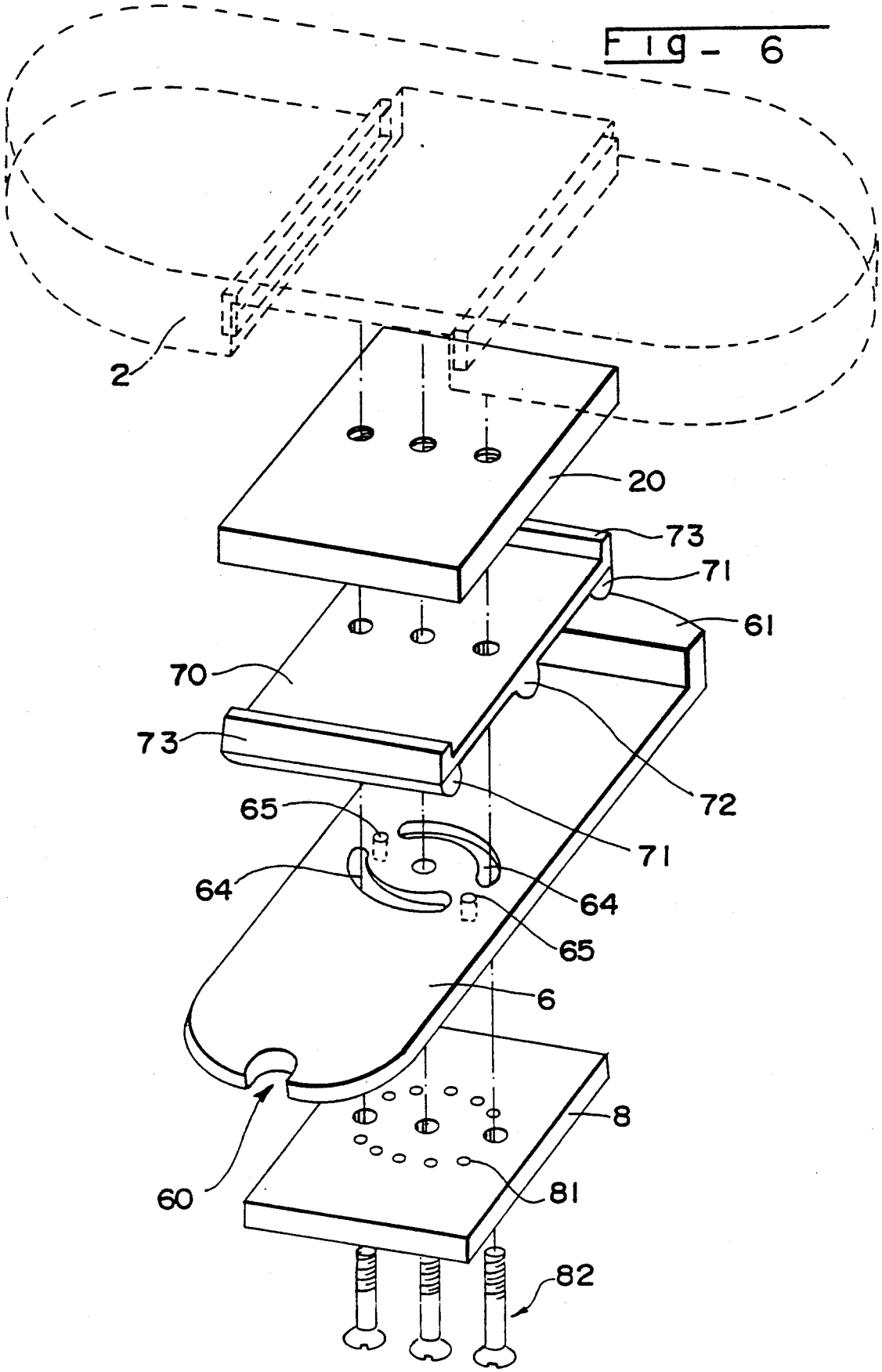
FIG. 6 is an exploded view of the releasable binding shown in FIG. 5.

The assembly constituted by the insert plate 20, the shock absorbing plate 70, and the intermediate plate 6, as shown in FIG. 6, is assembled by means of three screws 82 whose heads are embedded in a clamping plate 8.

Central screw 82 is guided through the holes made in each of plates 70, 6, 8 to be assembled, and is screwed in the insert plate 20, solidly affixed to boot 2.

The two other screws 82, in the illustrated embodiment, are guided through the cylindrical holes made in the clamping plate 8 and in the shock absorbing plate 70. These screws are also screwed into the insert plate 20.

The intermediate plate 6 has two oblong concentric slots 64. The two screws 82 cooperate with the oblong concentric slots 64 and enable the guidance of the intermediate plate 6 in rotation about the central screw 82.

Two projections 65 are rigidly affixed to the intermediate plate 6 and are embedded in holes 81 provided for that purpose in clamping plate 8.

The mounting means 7 make it possible, by means of the median part 72, to allow the lateral rotation of boot 2 of the skier, in a manner substantially transverse to snowboard 10. The elastomeric rollers 71 absorb forces that would otherwise be absorbed through the skier's boot 2 and foot with respect to snowboard 10.

The oblong concentric slots 64 make it possible, by cooperating with screws 82, to modify the orientation of the skier's boot 2 with respect to intermediate plate 6, which makes it possible to modify the orientation of the skier's feet with respect to the longitudinal axis of the snowboard.

Projections 65 enable the skier to index the intermediate plate 6 in a given position with respect to boot 2.

The above embodiment is described in a non-limiting manner, one with ordinary skill in the art being capable of deriving other possible embodiments within the scope of the present invention.

The means for solid affixation 58 for fixing base 5 to snowboard 10 are constituted by screws 58 guided within holes 57 made in base 5, which are screwed in snowboard 10. As shown in FIG. 1, two series of holes 57 are aligned on both sides of base 5, which enable the position of the base to be modified along the longitudinal axis of the snowboard. This makes it possible to modify the spacing of the skier's feet, for example.

Figure 5:
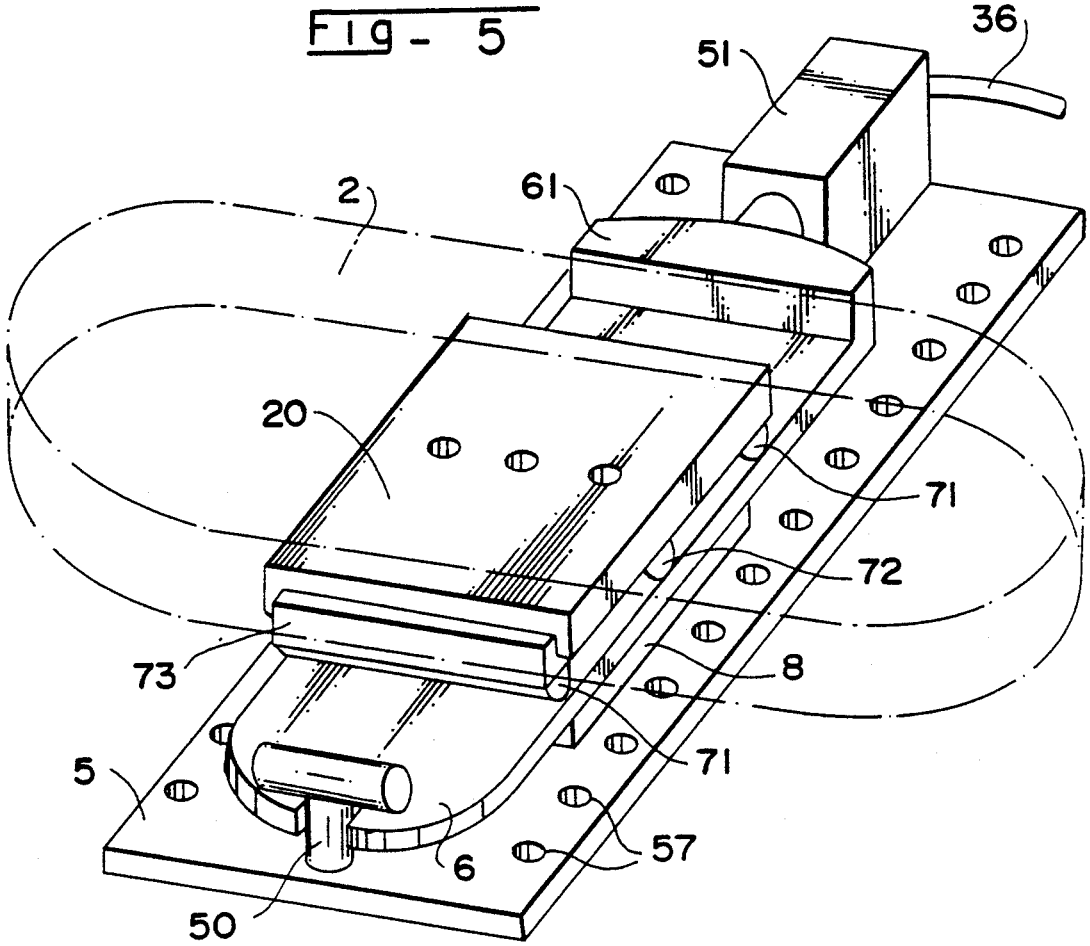
FIG. 5 is a perspective view of a releasable binding according to the invention.

Retention means 50, 51 for each boot 2 are constituted by a fixed abutment 50 rigidly affixed to base 5, and an abutment 51 which is movable with respect to base 5, as shown in FIGS. 4 and 5. Preferably, the fixed abutment 50 is located towards the front, and movable abutment 51 is located towards the rear, for the release of the boot during a frontward fall and/or during a lateral twisting fall.

FIG. 5 shows the fixed abutment 50 having a cylindrical T-shape, against which rests a cutout 60 provided in intermediate plate 6.

Movable abutment 51 is constituted by a ball 52 positioned in a piston 53 guided to sliding in a sealed fashion in a cylinder 54 partially closed at one of its ends so as to define a sealed rear chamber 59. Ball 52 cooperates with an recess 62 made in the rear part 61 of intermediate plate 6.

A toric joint 9 achieves the sealing of the front chamber 56 of piston 53 with respect to the exterior.

A lip seal 90 achieves the sealing between the rear chamber 59 and the front chamber of the piston 53. A compression spring 55 positioned in the rear chamber 59 rests, on the one hand, against the lip seal 90, on the other hand, against the rear wall of rear chamber 59.

Figure 2:
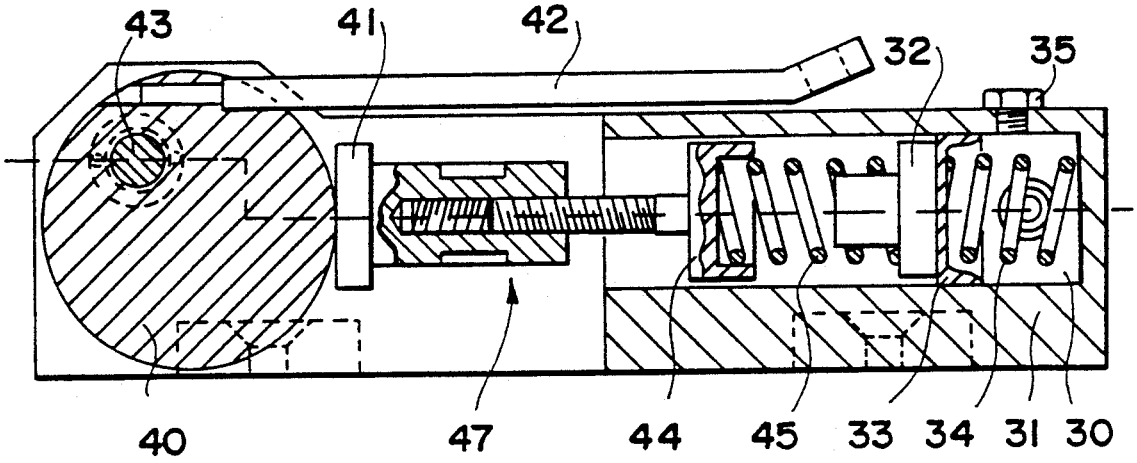
FIG. 2 is a transverse sectional view of the linkage device according to the invention.
Figure 3:
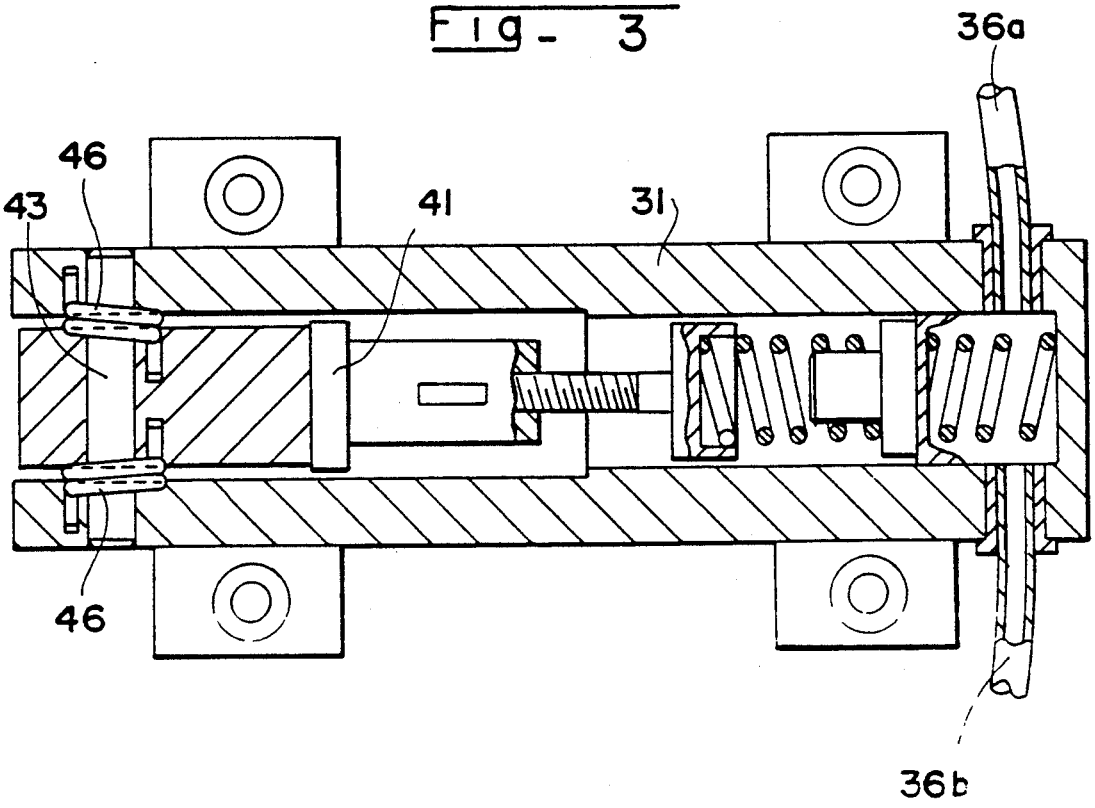
FIG. 3 is a top sectional view of the linkage device presented in FIG. 2.

The linkage device 3 connecting the retention means 50a, 51a and the retention means 50b, 51b is constituted by two flexible conduits 36a, 36b, each of the flexible conduits 36a, 36b connecting one of the rear chambers 59a, 59b to a single sealed chamber of a master cylinder 31, shown in FIGS. 2 and 3.

The rear chambers 59a, 59b, the flexible conduits 36a, 36b, as well as the chamber of master cylinder 31, are preferably filled with a hydraulic fluid 30.

The hydraulic fluid 30 is a fluid of appropriate quality, which resists cold, and whose fluidity varies little with respect to temperature variations. For example, a fluid with antifreeze additive products can be used.

Master cylinder 31 includes a lever 42 for controlling the rotation of an eccentric cam 40 about axis 43.

Eccentric cam 40 rests on an abutment pusher 41 connected by a screw-nut system 47 to secondary piston 44, making it possible to adjust the length of the assembly constituted by abutment pusher 41, the screw-nut system 47, and secondary piston 44.

The secondary piston 44 is guided in master cylinder 31, and rests on a main spring 45 which pushes a main piston 32, itself guided in master cylinder 31.

The sealing of the chamber defined by the rear wall of master cylinder 31 and the main piston 32 is achieved by a lip seal 33 maintained resting against the main piston 32 by a compression spring 34.

A plug 35 permits the filling of the chamber of the master cylinder 31 with fluid 30.

A torsion spring 46 connected to the eccentric cam 40 and the master cylinder 31 makes it possible to bring eccentric cam 40 back into the rest position as soon as the force exerted by the pusher abutment 41 on the eccentric cam 40 is less than a given threshold.

Figure 7:
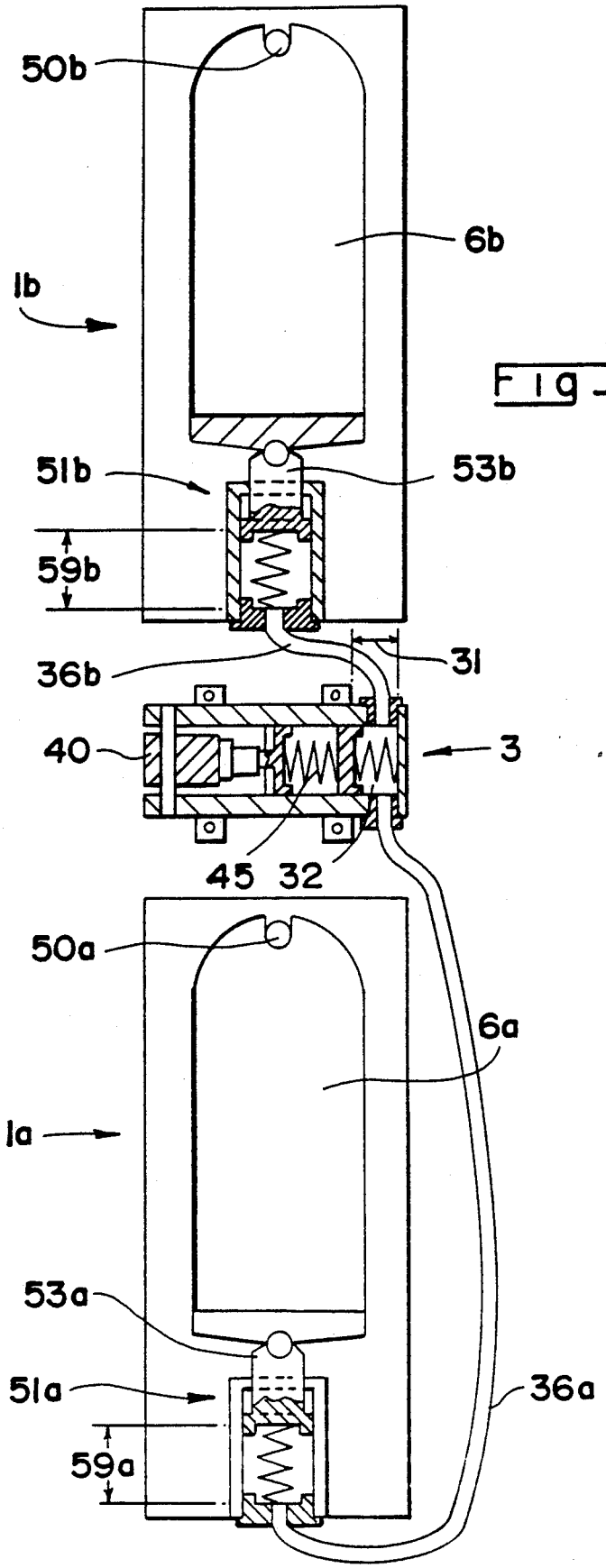
FIG. 7 illustrates, in a sectional plan view, a phase of the functioning of the releasable bindings assembly according to the invention.

FIG. 7 shows the two releasable bindings 1a, 1b connected by linkage device 3 constituted by flexible conduits 36a, 36b and by master cylinder 31. As shown in affixed to the snowboard 10 by means of intermediate plates 6 to which they are affixed. The two intermediate plates 6 are retained in a releasable manner by retention means 50, 51 on snowboard 10.

Each of the movable abutments 51 is elastically biased in the direction of the corresponding fixed abutment 50, against the return force of the elastic return system 45, 30, 32. In effect, intermediate plate 6 is in the inserted position, i.e., cutout 60 of intermediate plate 6 rests against the T-shaped abutment 50 of plate 5, and ball 52 of movable abutment 51 rests against opening 62 of intermediate plate 6. Piston 53 of movable abutment 51 is biased in its cylinder 54 by the pressure of fluid 30. The pressure of fluid 30 is a function of the action of master cylinder 31.

In fact, as arming lever 42 is lowered, eccentric cam 40 thus holds pusher abutment 41 in the armed position. This abutment-pusher 41 holds in turn secondary piston 44 in the armed, position. Main spring 45 rests on the secondary piston or pusher 44, on the one hand, and the compression of spring 45 generates a force which pushes main piston 32 on the other hand, in master cylinder 31. The hydraulic fluid 30 is thus under pressure in the chamber of master cylinder 31. This pressure is transmitted to the sealed rear chambers 59 of movable abutments 51 by means of flexible conduits 36a, 36b.

Each movable abutment 51 is thus elastically biased in the direction of the corresponding fixed abutment 50. The skier's two boots 2a, 2b are thus held on snowboard 10.

The initial pressure of fluid 30 can be adjusted by unscrewing (or screwing) the abutment pusher 41 with respect to pusher 44, as illustrated in FIG. 2. This has the effect of modifying the length of pusher 41, 44, 47, thus modifying the compression of main spring 45, and thus modifying the force transmitted to main piston 32 by this main spring 45. Thus, the initial pressure of fluid 30 is modified, which modifies the force transmitted by each movable abutment 51 in the direction of its associated fixed abutment 50. Thus, the retention force of intermediate plates 6 of snowboard 10 can be adjusted, which has the effect of adjusting the release threshold of releasable bindings 1a, 1b.

Figure 8:
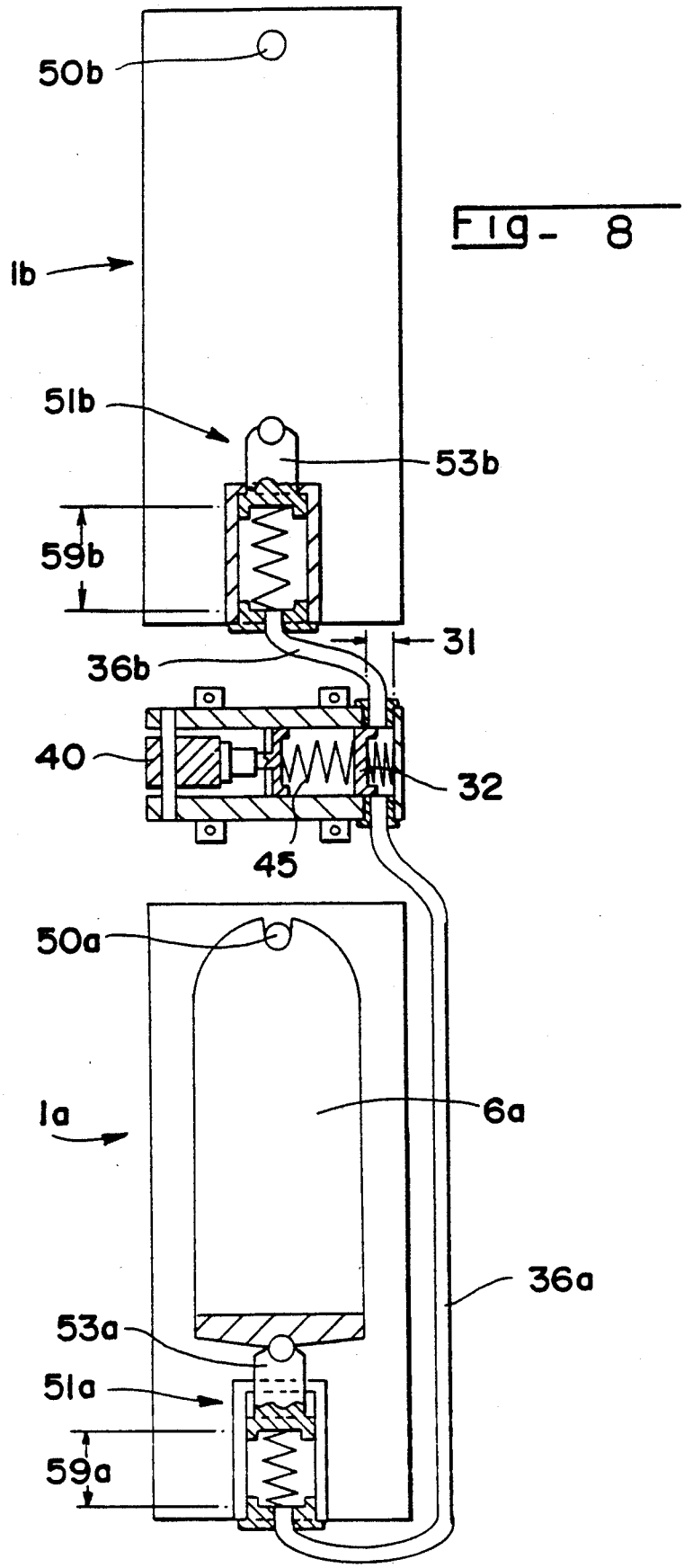
FIG. 8 illustrates, in a sectional plan view, another phase of functioning of the releasable bindings assembly according to the invention.

FIG. 8 shows the two releasable bindings 1a, 1b connected by linkage device, the boot 2a being rigidly affixed to snowboard 10, whereas the boot 2b is separated from snowboard 10 during a safety release.

When the skier's boot 2b exerts a force greater than the release threshold, during a fall, e.g., the intermediate plate 6b, rigidly affixed to boot 2b, escapes from its retention means 50b, 51b. The movable abutment 51b is then freed.

The rear chamber 59b of cylinder 54 the movable abutment 51 is thus enlarged. The fluid 30 is a hydraulic fluid which works at constant volume. The main spring 45 is thus relaxed, i.e., it extends, because the chamber of master cylinder 31 can decrease in volume to compensate for the increase of rear chamber 59b.

The elastic return force exerted by main spring 45 decreases because of its elongation. Thus, the pressure of fluid 30 becomes very weak. The return force of movable abutment 51a in the direction of fixed abutment 50a is thus decreased.

Consequently, the force to be overcome by intermediate plate 6a, against the return force of movable abutment 51a in the direction of fixed abutment 50a, is lessened. The intermediate plate 6a can thus be freed from its retention means 50a, 51a as soon as intermediate plate 6b is freed from its retention means 50b, 51b.

Figure 9:
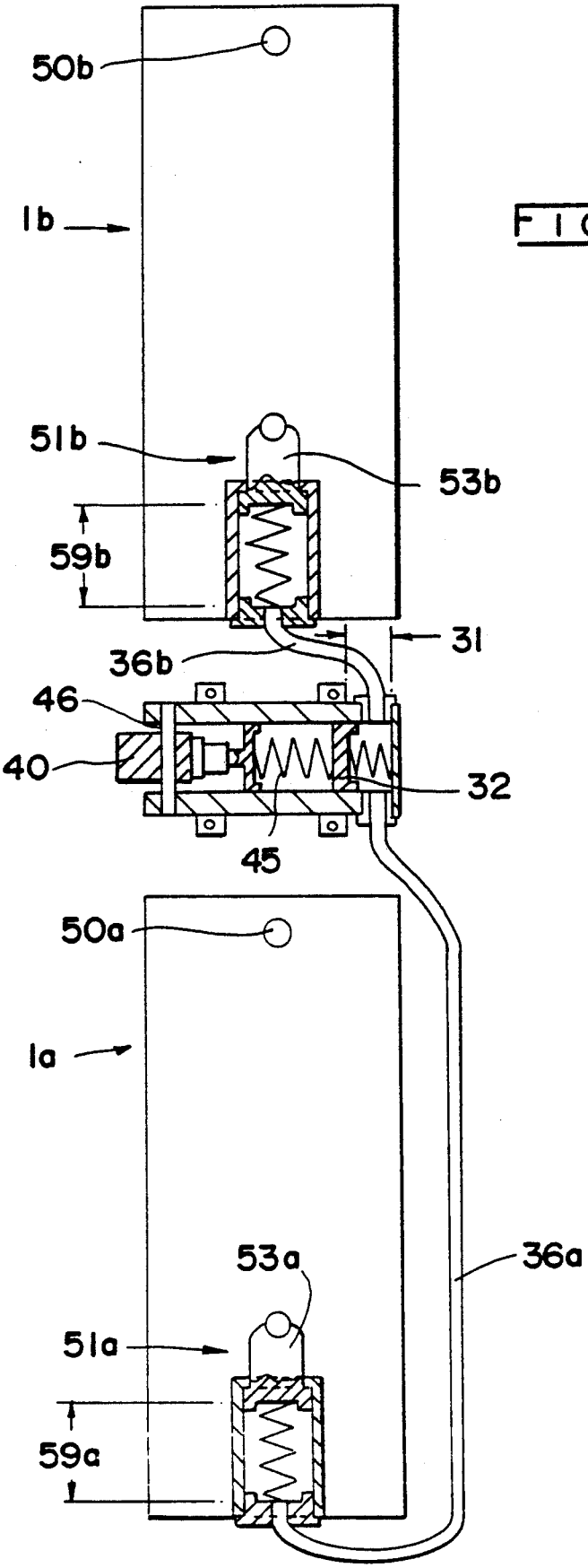
FIG. 9 illustrates, in a plan sectional view, another phase of the functioning of the assembly of releasable bindings according to the invention.

FIG. 9 shows the two releasable bindings 1a, 1b connected by linkage device, the two boots 2a, 2b being disconnected from snowboard 10 during a safety release.

The two intermediate plates 6 escape from their respective retention means 50, 51 following a force greater than the release threshold. The two movable abutments 51a and 51b are thus freed. The two rear chambers 59a and 59b are thus enlarged and the pressure of fluid 30 becomes substantially nil.

The main spring 45 relaxes because the chamber of master cylinder 31 can now decrease, the fluid 30 being under a pressure which is substantially nil. Consequently, the force exerted by main spring 45 on main piton 32 and on the secondary piston is substantially nil. This makes it possible for the torsion springs 46, by reaction, to move the eccentric cam 40 in rotation, so as to replace the arming lever 42 in the insertion position.

To put the boot on again, the skier must be able to place the intermediate plates 6, successively, in their respective retention means, against the elastic return force the compression spring 55, which pushes each piston 53 in the direction of each corresponding fixed abutment 50, generating an insertion force.

When the two intermediate plates 6 are placed in their respective retention means 50, 51, the skier must lower the arming lever 42 so as to pressurize fluid 30, which makes it possible for the movable abutments 51 to exert their elastic return force in the direction of their fixed associated abutment 50.

In the case of a voluntary removal of the boot, the skier must raise the arming lever 42, which has the effect of turning the eccentric cam 40 about its axis 43. Pusher 44, 41 can then translate, permitting main spring 45 to relax and thus lower the pressure of fluid 30. The elastic return force of each movable abutment 51 in the direction of the corresponding fixed abutment 50 then becomes very weak. The skier can then easily free the intermediate plates 6 which are solidly affixed to his boots, from retention means 50, 51.

Although the present invention has been described with respect to specific embodiments, the embodiments are to be considered merely illustrative and not restrictive, various modifications being possible without departing from the scope of the present invention which is defined by the following claims.

I claim:

1. A binding arrangement for a gliding board, comprising a first releasable binding for rigidly affixing a first boot to the gliding board and a second releasable binding for rigidly affixing a second boot to the gliding board, each of said releasable bindings comprising:

(a) a base adapted to be affixed to the gliding board;

(b) an intermediate plate adapted to be affixed to the boot;

(c) means for releasably retaining said intermediate plate on said base, said means comprising:

(i) a fixed abutment rigidly affixed to said base; and (ii) a movable abutment which is movable with respect to said base within a sealed cylinder having a sealed rear chamber, said movable abutment being operable between an armed position, in which said means for releasably retaining retains said intermediate plate, and an unarmed position, in which said means for releasably retaining allows the release of said intermediate plate with respect to said base, wherein in said armed position, said movable abutment is elastically biased toward said fixed abutment, against the return force of an elastic return system; and (d) a linkage device connecting said first releasable binding and said second releasable binding, wherein release of the boot functions to lessen said return force of said elastic return system which is exerted on said movable abutment and by said movable abutment against the boot, said linkage device comprising at least one flexible conduit connecting said sealed rear chamber of said movable abutment of said first releasable binding and said rear chamber of said movable abutment of said second releasable binding, said sealed rear chambers and said flexible conduit being filled with a hydraulic fluid.

2. The binding arrangement of claim 1, further comprising a master cylinder having a piston slidable therein and a main compression spring exerting a force against said piston for generating a pressure of said hydraulic fluid, wherein said linkage device comprises at least two flexible conduit segments, each of said segments of said flexible conduit connecting a respective sealed rear chamber to said master cylinder.

3. The binding arrangement of claim 2, wherein said master cylinder further comprising a pusher assembly and a main spring having one end biased against said main piston and another end biased against said pusher assembly, said master cylinder further comprising an arming lever operable for translating said pusher assembly within said master cylinder.

4. The binding arrangement of claim 3, further comprising a cam mounted for rotation with respect to said master cylinder, wherein said arming lever comprises a lever for controlling the rotation of said cam, wherein said cam effects translation of said pusher assembly during rotation of said cam, between an arming position wherein said pusher assembly compresses said main spring to thereby determine the pressure of said hydraulic fluid in said master cylinder and in said rear chambers of said releasable bindings, and a released position wherein said pusher assembly exerts a force less than a given threshold on said main spring.

5. The binding arrangement of claim 4, wherein said cam is biased in rotation by at least one torsion spring to bias said pusher assembly to return to said released position as soon as at least one of said intermediate plates is released with respect to said means for retaining.

6. The binding arrangement of claim 3, wherein said pusher assembly comprises at least an abutment pusher, a secondary piston, and a screw-nut mechanism, wherein said screw-nut mechanism is operable to adjust the distance between said abutment pusher and said secondary piston to vary the compression force of said main spring.

7. The binding arrangement of claim 4, wherein said pusher assembly comprises at least an abutment pusher, a secondary piston, and a screw-nut mechanism, wherein said screw-nut mechanism is operable to adjust the distance between said abutment pusher and said secondary piston to vary the compression force of said main spring.

8. The binding arrangement of claim 5, wherein said pusher assembly comprises at least an abutment pusher, a secondary piston, and a screw-nut mechanism, wherein said screw-nut mechanism is operable to adjust the distance between said abutment pusher and said secondary piston to vary the compression force of said main spring.

9. The binding arrangement of claim 1, wherein said compression spring is located within said sealed rear chamber of said movable abutment so as to abut against an end of said sealed rear chamber, such that said compression spring exerts a force toward said fixed abutment.

10. The binding arrangement of claim wherein said fixed abutment of each said binding is located forwardly of said movable abutment with respect to ski on an axis substantially parallel to the longitudinal axis of the gliding board.

11. A binding apparatus comprising a first binding assembly for retaining a first boot upon a ski, a second binding assembly for retaining a second boot upon the ski, and means for linking said first binding assembly and said second binding assembly and for reducing a threshold force exerted by one of said first binding assembly and said second binding assembly in response to release of a boot from the other of said first binding assembly and said second binding assembly, wherein each of said first binding assembly and said second binding assembly comprises a respective fluid biasing mechanism for exerting a retention force against a respective one of said first boot and said second boot, and wherein said means for linking comprises a fluid circuit in fluid communication between said fluid biasing mechanism of said first binding assembly and said fluid biasing mechanism of said second binding assembly.

12. The binding apparatus of claim 11, wherein said means for linking further comprises a master cylinder, a conduit connected between said master cylinder and said first binding assembly, and a conduit connected between said master cylinder and said second binding assembly.

13. The binding apparatus of claim 12, wherein said fluid is hydraulic.

14. The binding apparatus of claim 12, wherein each of said first binding assembly and said second binding assembly comprises a fixed abutment and a movable abutment, each of said movable abutments including a respective one of said fluid biasing mechanisms which includes a member biased by said fluid toward a respective one of said fixed abutments.

15. The binding apparatus of claim 14, wherein each of said fluid biasing mechanisms further includes a sealed chamber and wherein said member comprises a piston movable within said chamber.

16. The binding apparatus of claim 15, wherein each of said chambers includes a compression spring located therein for exerting a force against said piston.

17. The binding apparatus of claim 14, wherein each of said fixed abutments is adapted to be positioned forwardly of a respective one of said movable abutments with respect to the front of the ski.

18. The binding apparatus of claim 11, wherein each of said first binding assembly and said second binding assembly comprises a plate, means for affixing a ski boot to said plate, and means for releasably engaging said plate for retaining a respective one of said first boot and said second boot upon the ski.

19. The binding apparatus of claim 18, wherein each of said first binding assembly and said second binding assembly further comprises means for adjustably positioning a respective one of said first boot and said second boot upon a respective one of said plates.

20. The binding apparatus of claim 19, wherein said means for adjustably positioning a respective one of said first boot and said second boot comprises means for selectively rotatably positioning said respective boot about an axis which is generally perpendicular to an upper ski surface.

21. The binding apparatus of claim 14, further comprising means for manually reducing the biasing force of each of said fluid biasing mechanisms.

22. The binding apparatus of claim 21, wherein said master cylinder comprises a chamber in fluid communication with said conduits, wherein said master cylinder further comprises a main piston movably mounted for effecting a change in the volume of said chamber, and wherein said means for manually reducing the biasing force of each of said fluid biasing mechanisms comprises means for effecting movement of said main piston for increasing the volume of said chamber.

23. The binding apparatus of claim 22, wherein said means for manually reducing the biasing force of each of said fluid biasing mechanisms further comprises a lever adapted to be accessible to the wearer of the boots.

24. The binding apparatus of claim 23, wherein said means for manually reducing the biasing force of each of said fluid biasing mechanisms further comprises means operatively associated between said main piston and said lever for adjusting the pressure of said fluid for adjusting said biasing force of each of said fluid biasing mechanisms.

25. The binding apparatus of claim 11, wherein said first binding assembly and said second binding assembly are adapted to position the first and second boots transversely on said ski, with respect to a longitudinal axis of said ski.

26. The binding apparatus of claim 25, further comprising means for adjusting the orientation of the boots with respect to the ski.

27. The binding apparatus of claim 14, wherein said fixed abutment and said movable abutment of each of said first binding assembly and said second binding assembly are adapted to be positioned generally along the longitudinal axis of said ski.

28. The binding apparatus of claim 27, wherein said means for linking further comprises a master cylinder, a conduit connected between said master cylinder and said first binding assembly, and a conduit connected between said master cylinder and said second binding assembly, wherein said master cylinder is positioned between said first binding assembly and said second binding assembly.

29. The binding apparatus of claim 11 in combination with a monoski.

30. The binding apparatus of claim in combination with a snowboard.

31. A binding apparatus comprising:

a first binding assembly for retaining a first boot upon a ski and for releasing said first boot when said first boot exerts on said first binding assembly a force overcoming a predefined threshold force, said first binding assembly comprising a first fluid biasing mechanism for exerting a retention force against said first boot;

a second binding assembly for retaining a second boot upon the ski and for releasing said second boot when said second boot exerts on said second binding assembly a force overcoming a predefined threshold force, said second binding assembly comprising a second fluid biasing mechanism for exerting a retention force against said second boot; and means for linking said first binding assembly and said second binding assembly, wherein said linking means comprises a fluid guided in at least one conduit for generating a reduction of the threshold force of said first binding assembly and said second binding assembly in response to release of a boot from the other of said first binding assembly and said second binding assembly.

* * * * *